US007788894B2

(12) United States Patent
Fink

(10) Patent No.: US 7,788,894 B2
(45) Date of Patent: Sep. 7, 2010

(54) SPINDLE BEARING FOR A DOUBLE-THREAD TWISTING SPINDLE

(75) Inventor: Heinz Fink, Krefeld (DE)

(73) Assignee: Oerlikon Textile GmbH & Co. KG, Monchengladback (DE)

( * ) Notice: Subject to any disclaimer, the term of this patent is extended or adjusted under 35 U.S.C. 154(b) by 478 days.

(21) Appl. No.: 11/989,557

(22) PCT Filed: Jul. 5, 2006

(86) PCT No.: PCT/EP2006/006528

§ 371 (c)(1),
(2), (4) Date: Jan. 28, 2008

(87) PCT Pub. No.: WO2007/014612

PCT Pub. Date: Feb. 8, 2007

(65) Prior Publication Data

US 2009/0263060 A1 Oct. 22, 2009

(30) Foreign Application Priority Data

Jul. 30, 2005 (DE) ..... 10 2005 035 895

(51) Int. Cl.
*D01H 1/10* (2006.01)

(52) U.S. Cl. ..... 57/58.49

(58) Field of Classification Search ..... 57/58.49
See application file for complete search history.

(56) References Cited

U.S. PATENT DOCUMENTS

| | | | | |
|---|---|---|---|---|
| 2,942,919 A | | 6/1960 | Beerli | 308/187 |
| 3,645,083 A | | 2/1972 | Lohring et al. | 57/88 |
| 3,945,695 A | * | 3/1976 | Speakman | 384/291 |
| 5,863,048 A | * | 1/1999 | Pingel | 277/609 |

FOREIGN PATENT DOCUMENTS

| | | |
|---|---|---|
| DE | 195 02 135 A1 | 11/1996 |
| DE | 102 50 423 A1 | 5/2004 |
| WO | WO 90/11188 | 10/1990 |

* cited by examiner

*Primary Examiner*—Shaun R Hurley
(74) *Attorney, Agent, or Firm*—K&L Gates, LLP

(57) ABSTRACT

A spindle bearing for a two-for-one twisting spindle, with a spindle rotor having a thread guide body and a spindle shaft rotatably mounted in a vertical arrangement by a lower bearing device in a bearing housing which can be fastened to a spindle bank and which has an upper bearing device for mounting a protective pot. A lubricant duct extends from the top through the thread guide body at least approximately parallel to the rotational axis of the spindle shaft and opens into the lower bearing device.

8 Claims, 2 Drawing Sheets

SPINDLE BEARING FOR A DOUBLE-THREAD TWISTING SPINDLE

CROSS-REFERENCE TO RELATED APPLICATIONS

This application claims the benefit of German patent application DE 10 2005 035 895.0, filed Jul. 30, 2005, herein incorporated by reference.

BACKGROUND OF THE INVENTION

The invention relates to a spindle bearing for a two-for-one twisting spindle. More particularly, the invention relates to such a spindle bearing for a twisting spindle having a spindle rotor with a thread guide body and a spindle shaft rotatably mounted in a vertical arrangement by a lower bearing device in a bearing housing which can be fastened to a spindle bank and which has an upper bearing device for mounting a protective pot.

Conventional two-for-one twisting spindles comprise a spindle bearing, a driven rotor element and a protective pot for receiving the bobbin. Their spindle bearing has two bearing regions. In an upper bearing region, the protective pot is mounted on the rotor element so as to be rotatable relative thereto. Both the pressing forces of a tangential belt, which drives the rotor element by means of a wharve and the axially acting forces from the weight of the protective pot and the bobbin located therein are received in a lower bearing region. The roller bearings of the lower bearing region are designed for a conventional service life of about 50,000 hours. The roller bearings in the upper bearing region, on the other hand, are designed such that they do not reach this service life. After an operating period, which is between 20,000 and 30,000 hours, they are changed. The change can be carried out easily and rapidly as the upper bearing region is easily accessible after removal of the protective pot. This easy accessibility does not exist in the lower bearing region as the wharve is pressed onto the spindle shaft of the rotor element and therefore removal of the wharve is not possible. The roller bearings in the lower bearing region are therefore generally relubricated with standard greases to reach the service life of 50,000 hours.

A spindle bearing for a two-for-one twisting spindle is known, for example, from German Patent Publication DE-A-195 02 135. Ducts for supplying or removing lubricating grease are introduced into the bearing housing of the lower bearing region. A grease supply duct and a grease removal duct are allocated to each roller bearing. The grease supply duct and grease removal duct are in each case connected to a grease supply opening or grease removal opening. The grease supply opening or the grease removal opening forms the end of a horizontal duct on the outside of the bearing housing. Introducing duct portions with different directions, as shown in German Patent Publication DE-A-195 02 135 is complex and expensive in terms of production technology.

German Patent Publication DE-A-102 50 423 describes a generic spindle bearing for a two-for-one twisting spindle, the spindle rotor of which has a spindle shaft, which is rotatably mounted by means of an upper and a lower roller bearing. The bearing housing has a grease duct extending transversely to the rotational axis of the spindle rotor. In the interior of the bearing housing, the grease is distributed by means of a conical distributor ring and supplied to the bearings. To hold the distributor ring, a peripheral groove which is to be introduced into the spindle shaft is required. In the design of the bearing of German Patent Publication DE-A-102 50 423, with the distributor ring being used merely for grease distribution, compared to other known spindle bearings, an additional part and additional assembly outlay for this part are necessary.

Both German Patent Publications DE-A-195 02 135 and DE-A-102 50 423 show spindle bearings, in which the accessibility of the grease ducts when introducing the lubricant is impaired owing to their position. The possibilities of a compact configuration of the two-for-one twisting spindle are also limited by the position of the grease ducts half way up between the roller bearings of the lower bearing.

SUMMARY OF THE INVENTION

The object of the invention is to eliminate the described drawbacks and to improve the known spindle bearings. This object is achieved with a spindle bearing for a two-for-one twisting spindle, the spindle rotor of which has a thread guide body and a spindle shaft, which is rotatably mounted in a vertical arrangement by means of a lower bearing device in a bearing housing which can be fastened to a spindle bank and which has an upper bearing device for mounting a protective pot. According to the present invention, a lubricant duct extends from the top through the thread guide body at least approximately parallel to the rotational axis of the spindle shaft and opens into the lower bearing device.

Advantageous configurations of the invention are described more fully hereinafter.

A lubricant duct extending from the top through a thread guide body parallel to the rotational axis of the spindle shaft and opening into the lower bearing device is easily accessible after removal of the protective pot for the greasing process. The placing of a grease gun takes place in a vertical direction and is ergonomically favourable for the maintenance person. The lubricant can enter the bearing region because of the vertical position of the spindle and the running vibrations of the bearing, assisted by gravitational force.

If the lubricant duct is introduced into a fastening screw with a screw head pointing upward, with which screw the thread guide body can be fixed relative to the spindle shaft, apart from the holes for the fastening screws, no additional grease duct through the thread guide body is necessary. A conventional lubricating nipple is not required. This avoids costs for a conventional lubricating nipple and also costs for assembling a nipple of this type.

With a colour identification of the screw head, by means of which it can be distinguished from screw heads of further fastening screws without a lubricant duct, the position of the fastening screw with a lubricant duct can be seen at first glance and rapid regreasing is possible.

If the diameter of the lubricant duct is a maximum of 1.2 mm, both the size of the passage for the lubricant and also the retaining effect of the fastening screw are adequate.

The lubricant duct advantageously traverses a ring, which surrounds the spindle shaft and is rigidly connected thereto. A ring of this type brings about stabilisation of the fastening and allows the screw to be securely engaged.

The rotating ring and the lower bearing device are preferably surrounded by a stationary bearing housing and a gap seal is formed between the bearing housing and the ring. The gap seal prevents the lubricant introduced through the lubricant duct into the lower bearing device rising again. This takes place in a simple manner by a configuration of the ring such that there is only a small spacing between the ring and the bearing housing so no additional sealing elements are required here. Outlay for assembly connected with additional sealing elements is avoided.

The lower bearing device advantageously comprises two roller bearings which are axially spaced apart from one another, a lubricant store, into which the lubricant duct opens, being arranged above the upper roller bearing. In this manner, an adequate supply of lubricant can be introduced into the lower bearing device, which on rotation of the rotor element under the influence of gravitational force can be distributed in such a way that the two roller bearings are satisfactorily lubricated.

If the spindle shaft is driven by means of a pot-shaped wharve, the wharve at least partially surrounding the bearing housing of the lower bearing device, a compact mode of construction of the spindle bearing is possible. The position and configuration of the wharve allow a substantially uniform loading of the roller bearing of the lower bearing device.

The spindle bearing according to the invention allows a compact, economical design and an improvement in the lubrication.

BRIEF DESCRIPTION OF THE DRAWINGS

Further details of the invention can be inferred from the embodiments of the figures, in which.

DETAILED DESCRIPTION OF THE PREFERRED EMBODIMENTS

Figure 1:
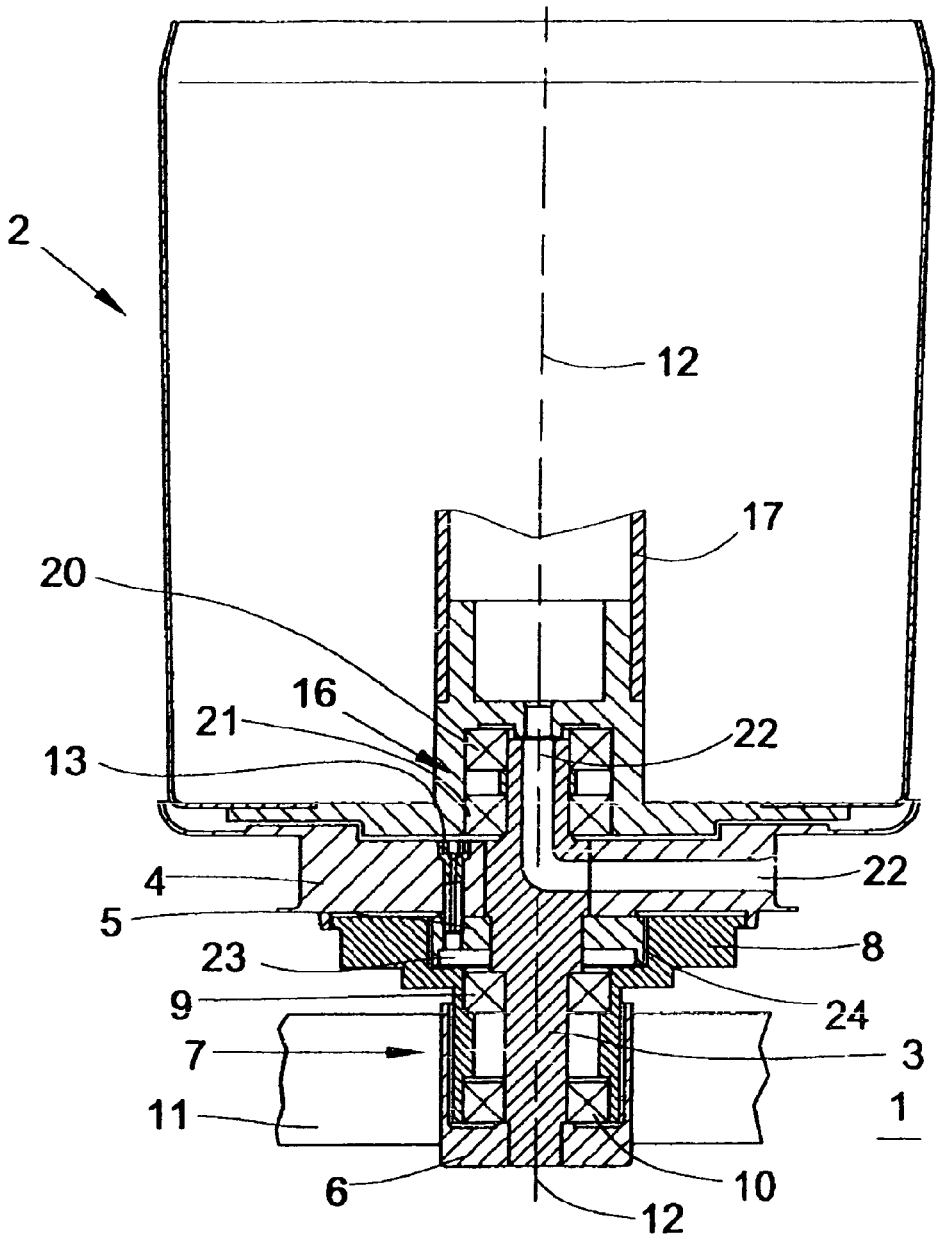
FIG. 1 shows a section through the spindle bearing of a two-for-one twisting spindle.
Figure 3:
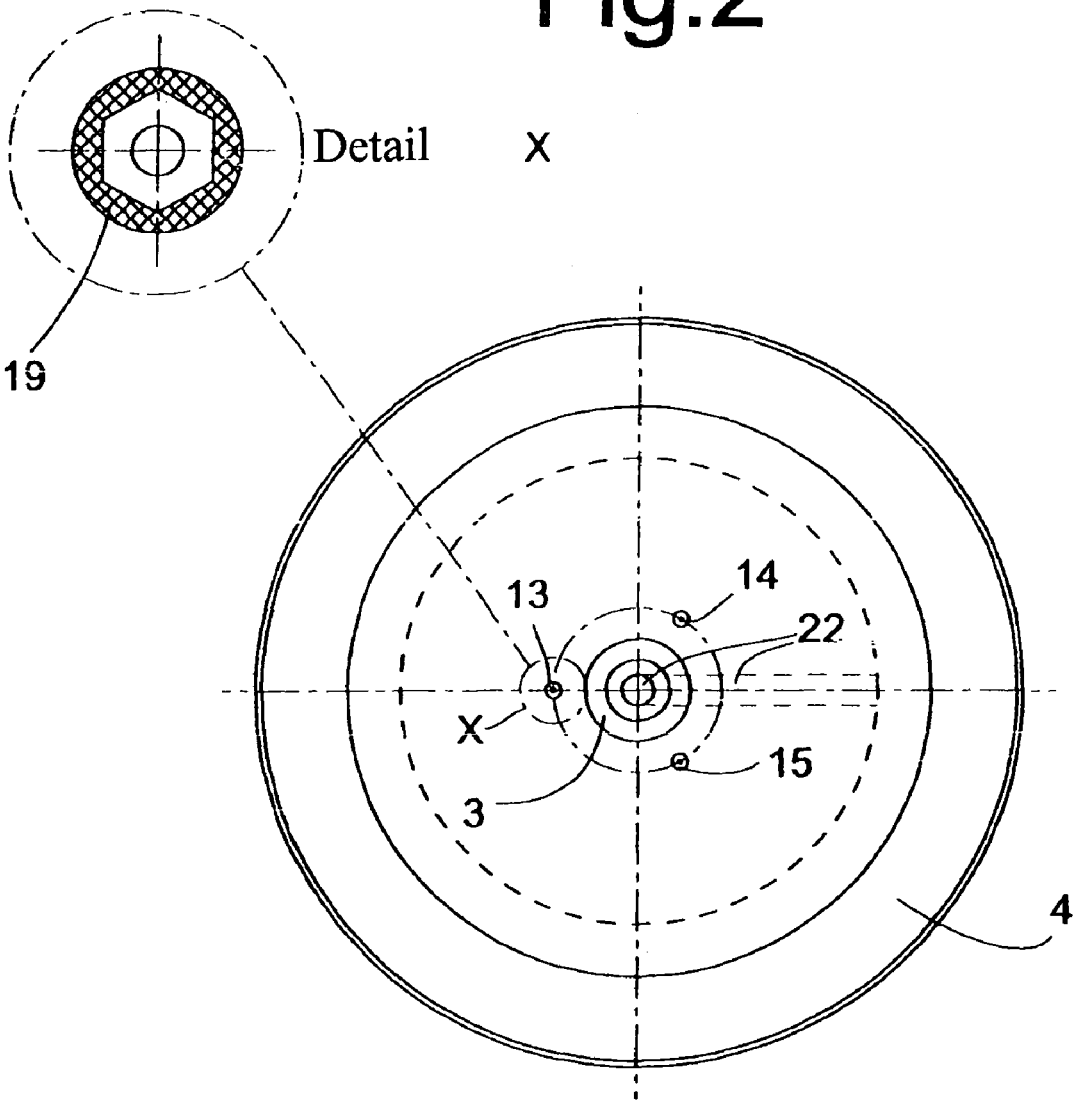
FIG. 3 shows a plan view of the thread guide ring and the spindle shaft with the protective pot removed and the detail X in an enlarged view.

FIG. 1 shows a spindle bearing 1 with a protective pot 2. The protective pot 2 is placed on a spindle rotor. The spindle rotor comprises the spindle shaft 3, the thread guide body 4, the ring 5 and the wharve 6. The spindle shaft 3 is rotatably mounted in the bearing housing 8 by means of the lower bearing device 7. The rotational axis 12 of the spindle shaft 3 is arranged vertically. The bearing housing 8 is rigidly connected to a spindle bank known per se and not shown for reasons of simplification. The lower bearing device 7 has two roller bearings 9, 10 which are axially spaced apart from one another. The wharve 6 is pot-shaped and pressed onto the lower end of the spindle shaft 3 in the view of FIG. 1. A tangential belt 11, which imparts a rotary movement to the spindle rotor via the wharve 6, acts on the wharve 6. Above the lower bearing device 7, the ring 5 is pressed onto the spindle shaft 3. The thread guide body 4 rests on the ring 5 and is rigidly connected thereto by means of a screw connection. Of the screw connection, FIG. 1 only shows the fastening screw 13. In the embodiment shown, the screw connection takes place by means of the fastening screws 13, 14, 15, as can be seen from the view of FIG. 3.

An upper bearing device 16, on which the protective pot 2 is placed, is arranged on the upper end of the spindle shaft 3. Consequently, the protective pot 2 is rotatable relative to the spindle shaft 3. A bobbin, of which only a part of the tube 17 is shown in FIG. 1, can be mounted in the protective pot 2. The upper bearing device 16 comprises two roller bearings 20, 21, which are vertically spaced apart from one another. A thread guide duct 22, such as is shown in FIG. 1, and known, for example, from German Patent Publication DE-A-102 50 423, runs through the protective pot 2, the spindle shaft 3 and the thread guide body 4.

Figure 2:
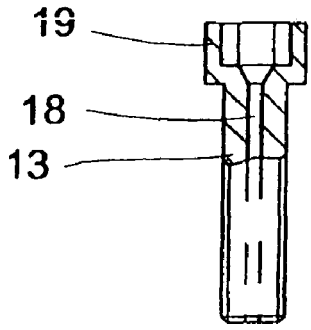
FIG. 2 shows a section through a fastening screw with a lubricant duct in an enlarged view compared to FIG. 1.

The fastening screws 13, 14, 15 are configured as hexagon socket screws. FIG. 2 shows the fastening screw 13 in an enlarged view. A lubricant duct 18, which, proceeding from the hexagon socket in the screw head 19 traverses the fastening screw 13 in the longitudinal direction as a hole, is introduced into the fastening screw 13. The fastening screw 13 replaces a conventional lubricating nipple. The fastening screw 13 is produced simply and economically by boring. The hole forming the lubricant duct has a diameter of 1.2 mm, for example.

The lubricant duct 18 opens into a cavity 23 above the roller bearing 9 of the lower bearing device 7, the cavity 23 being used as a lubricant store. The ring 5 is formed in such a way that, with the stationary bearing housing 8 surrounding it, it forms a gap seal 24.

During maintenance, which is carried out to check the state of the roller bearings 20, 21 of the upper bearing device 16, the protective pot 2 is removed from the spindle shaft 3. The fastening screw 13 thus simultaneously becomes visible or exposed and without additional outlay, easy unimpeded access to the fastening screws 13, 14, 15 is provided. The screw head 19 of the fastening screw 13 is marked by colour and therefore can be recognised at first glance without searching. The coloured marking is indicated in the detail X of FIG. 3 by cross hatching.

The grease used as a lubricant is generally introduced with a grease gun. The grease gun can be placed, in an ergonomically favourable manner for the operator, in a vertical position on the screw head 19 of the fastening screw 13. The grease quantity required for the lower bearing device 7 is introduced through the lubricant duct 18 of the fastening screw 13 into the cavity 23. The gap seal 24 prevents the grease rising up from the cavity 23 and therefore escaping from the lower bearing device 7. The cavity 23 is dimensioned such that the grease quantity required for adequate lubrication of the roller bearings 9, 10 does not completely fill up the cavity 23. The grease, or the oil located in the grease, because of the vertical arrangement of the spindle shaft 3 and therefore the vertical arrangement of the lower bearing device 7 and under the influence of gravitational force and the running vibrations, to which the lower bearing device 7 is subjected, can reach the roller bearings 9, 10 and enter them.

What is claimed is:

1. Spindle bearing for a two-for-one twisting spindle, the spindle rotor of which has a thread guide body and a spindle shaft, which is rotatably mounted in a vertical arrangement by means of a lower bearing device in a bearing housing which can be fastened to a spindle bank and which has an upper bearing device for mounting a protective pot, characterised by a lubricant duct (18) extending from the top through the thread guide body (4) at least approximately parallel to the rotational axis (12) of the spindle shaft (3) and opening into the lower bearing device (7).

2. Spindle bearing according to claim 1, characterised in that the lubricant duct (18) is introduced into a fastening screw (13) with a screw head (19) pointing upward, with which screw (13) the thread guide body (4) can be secured to the spindle shaft (3).

3. Spindle bearing according to claim 2, characterised in that the screw head (19) is characterised by colour in such a way that it can be distinguished from screw heads of further fastening screws (14, 15).

4. Spindle bearing according to claim 1, characterised in that the diameter of the lubricant duct (18) is a maximum of 1.2 mm.

5. Spindle bearing according claim 1, characterised in that the lubricant duct (18) traverses a ring (5), which surrounds the spindle shaft (3) and is rigidly connected thereto.

6. Spindle bearing according to claim 5, characterised in that the rotating ring (5) and the lower bearing device (7) are surrounded by the bearing housing (8) and a gap seal (24) is formed between the bearing housing (8) and the ring (5).

7. Spindle bearing according to claim 1, characterised in that the lower bearing device (7) comprises two roller bearings (9, 10) which are axially spaced apart from one another and a lubricant store into which the lubricant duct (18) opens is arranged above the upper roller bearing (9).

8. Spindle bearing according to claim 1, characterised in that the spindle shaft is driven by means of a pot-shaped wharve (6) and the wharve (6) at least partially surrounds the bearing housing (8).

* * * * *